US005487943A

United States Patent [19]

Kozulla

[11] Patent Number: 5,487,943

[45] Date of Patent: Jan. 30, 1996

[54] MULTICONSTITUENT FIBERS, AND NONWOVEN STRUCTURES OF SUCH FIBERS

[75] Inventor: Randall E. Kozulla, Social Circle, Ga.

[73] Assignee: Hercules Incorporated, Wilmington, Del.

[21] Appl. No.: 395,484

[22] Filed: Feb. 27, 1995

Related U.S. Application Data

[63] Continuation of Ser. No. 47,407, Apr. 19, 1993, abandoned.

[51] Int. Cl.[6] ..... D02G 3/00

[52] U.S. Cl. ..... 428/373; 428/374; 428/401; 525/240; 522/161; 522/112; 522/912

[58] Field of Search ..... 525/240; 428/372, 428/373, 374, 401; 522/912, 161, 112

[56] References Cited

U.S. PATENT DOCUMENTS

| | | | |
|---|---|---|---|
| 3,294,869 | 12/1966 | Robinson | 522/161 |
| 3,537,969 | 11/1970 | Kelley et al. | 422/22 |
| 3,616,149 | 10/1971 | Wincklhofer et al. . | |
| 3,940,325 | 2/1976 | Hirao | 422/22 |
| 4,282,076 | 9/1981 | Boynton | 522/912 |
| 4,350,006 | 9/1982 | Okamoto et al. | 57/250 |
| 4,401,536 | 9/1983 | Lundell et al. | 522/112 |
| 4,431,497 | 2/1984 | Rekers | 422/22 |
| 4,501,856 | 2/1985 | Harpell et al. | 325/240 |
| 4,525,257 | 6/1985 | Kurtz et al. | 522/912 |
| 4,569,736 | 2/1986 | Kosegaki et al. | 422/22 |
| 4,598,128 | 7/1986 | Randall et al. | 522/161 |
| 4,632,861 | 12/1986 | Vassilatos . | |
| 4,634,739 | 1/1987 | Vassilatos . | |
| 4,739,025 | 4/1988 | Burch | 526/348.1 |
| 4,830,907 | 5/1989 | Sawyer et al. . | |
| 4,839,228 | 6/1989 | Jezic et al. | 525/240 |
| 4,874,666 | 10/1989 | Kubo et al. . | |
| 4,880,691 | 11/1989 | Sawyer et al. . | |
| 4,909,975 | 3/1990 | Sawyer et al. . | |
| 4,931,230 | 6/1990 | Krueger et al. | 422/22 |
| 4,990,204 | 2/1991 | Krupp et al. . | |
| 5,041,491 | 9/1991 | Turke et al. | 525/240 |
| 5,059,482 | 10/1991 | Kawamoto et al. | 528/373 |
| 5,108,827 | 4/1992 | Gessner . | |
| 5,122,593 | 6/1992 | Jennings et al. | 422/22 |
| 5,133,917 | 7/1992 | Jezic et al. | 428/401 |
| 5,147,930 | 8/1992 | Peszkin et al. | 525/240 |
| 5,294,482 | 3/1994 | Gessner | 428/287 |

FOREIGN PATENT DOCUMENTS

| | | |
|---|---|---|
| 0260974 | 9/1987 | European Pat. Off. . |
| 0277707 | 1/1988 | European Pat. Off. . |
| 522995 | 1/1993 | European Pat. Off. . |
| 59-41342 | 3/1984 | Japan . |
| 3279459 | 12/1991 | Japan . |
| 9010672 | 9/1990 | WIPO . |
| 94/17226 | 8/1994 | WIPO . |

OTHER PUBLICATIONS

English Language abstract of Japanese Patent Publication No. 3–279459.

English Language abstract of Japanese Patent Publication No. 59–41342.

*Primary Examiner*—N. Edwards

*Attorney, Agent, or Firm*—Mark D. Kuller

[57] ABSTRACT

Multiconstituent fibers having a dominant continuous linear low density polyethylene phase, and one or more discontinuous phase polymers, dispersed through the dominant continuous phase in the form of domains. The indicated discontinuous phases polymers are chosen from among polypropylene and poly(propylene-co-ethylene) copolymers.

24 Claims, 12 Drawing Sheets

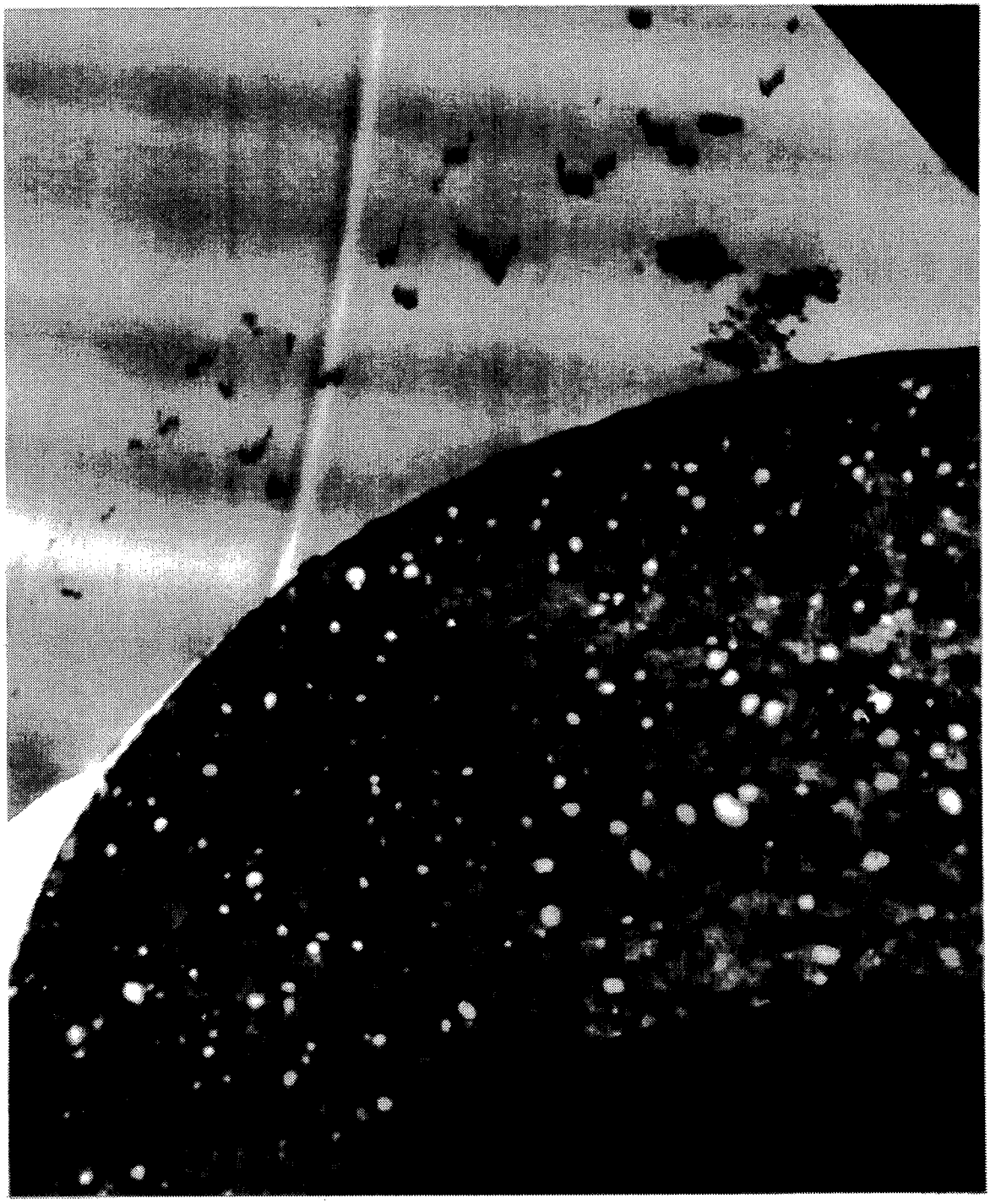
FIG. 8 1.0 μm

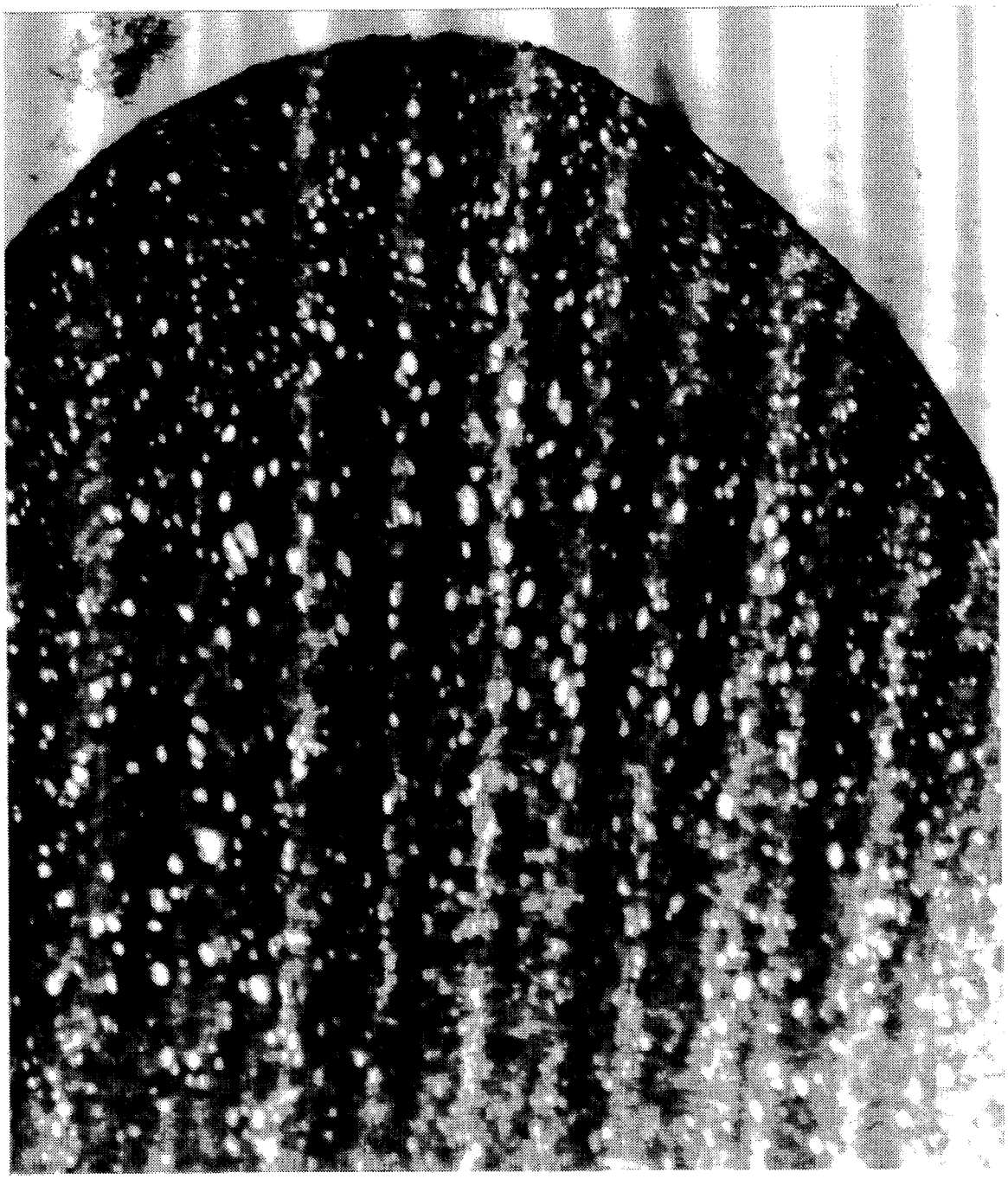
FIG. 9 1.0 μm

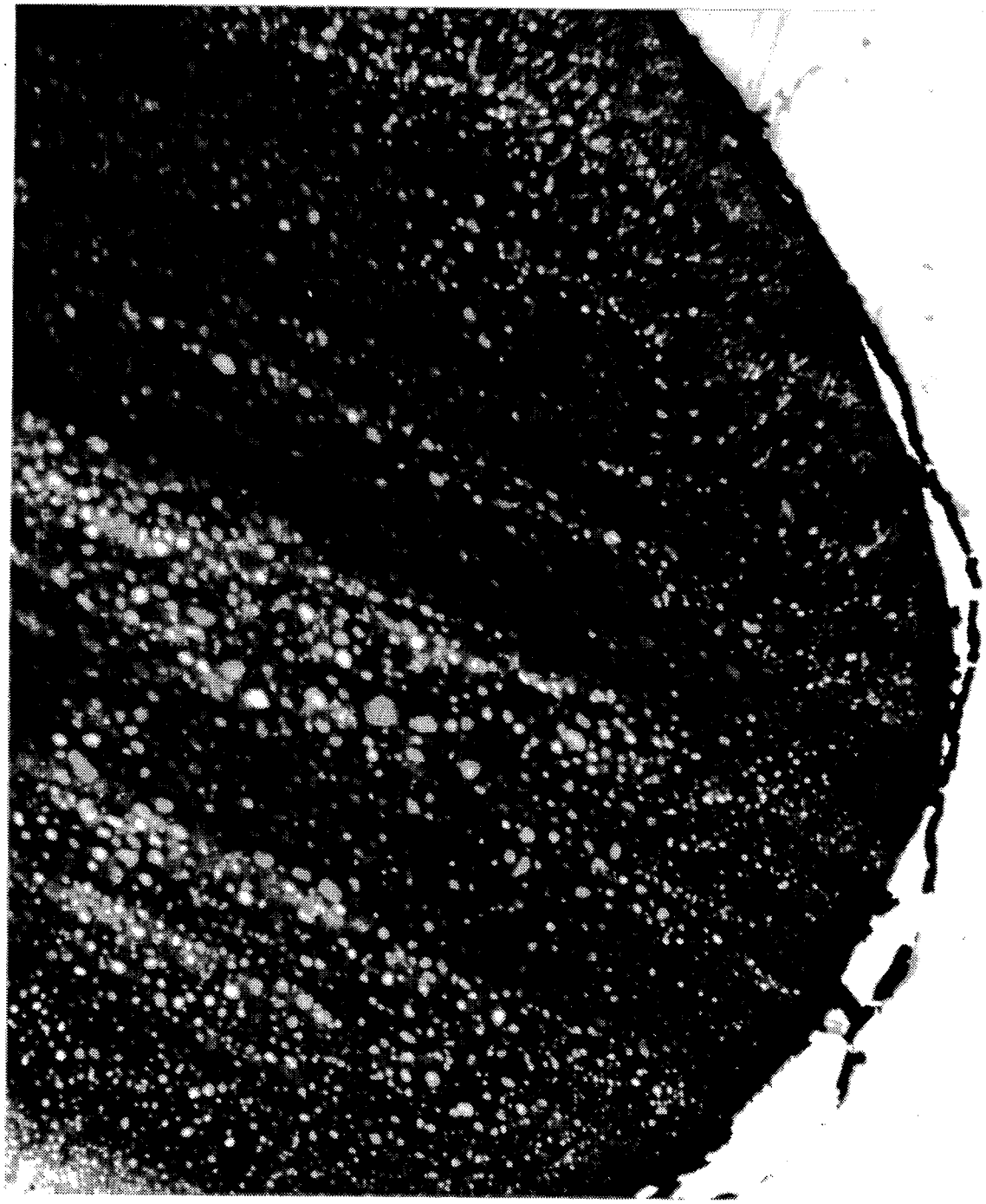
FIG. 10 1.0 μm

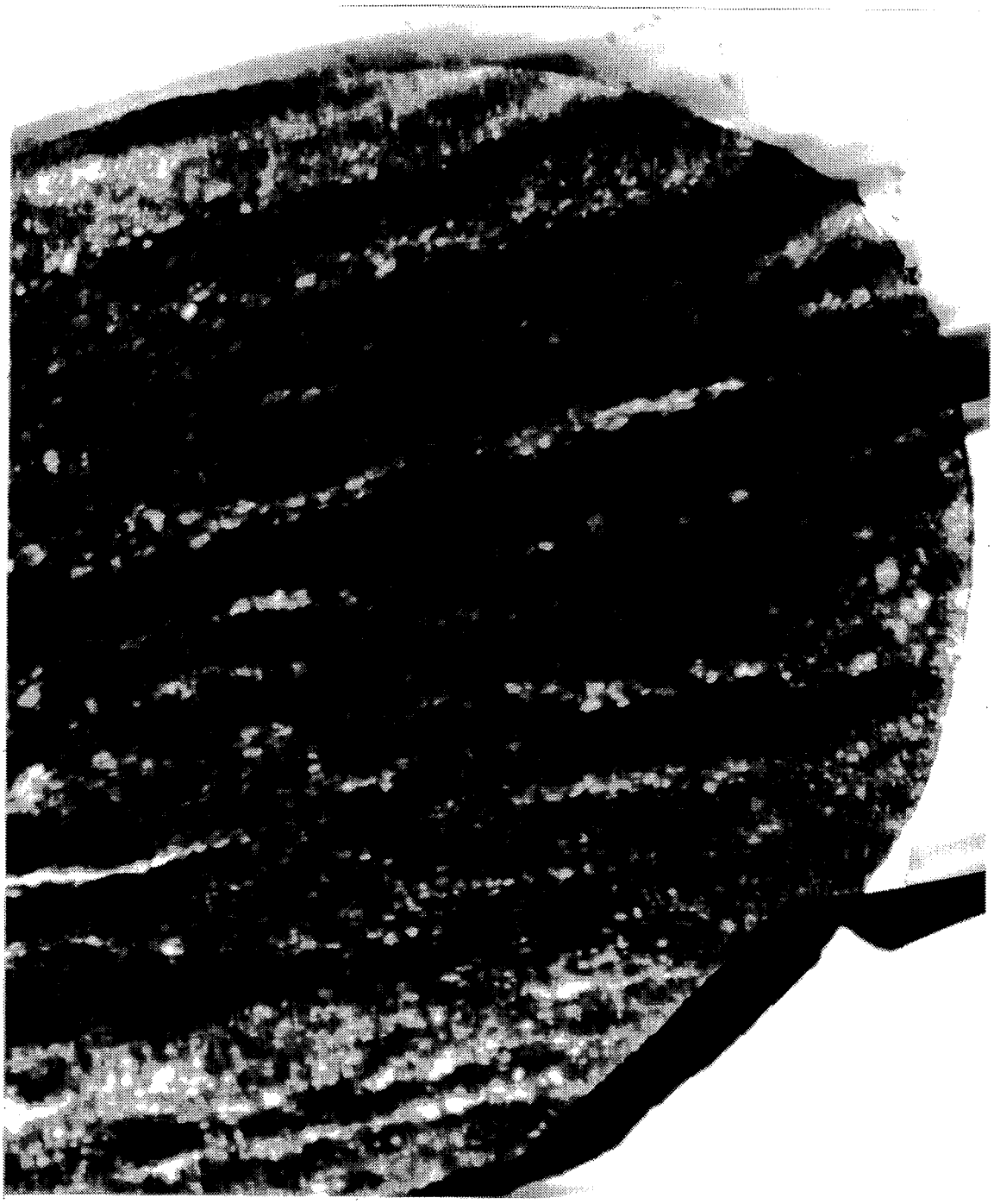
FIG. 11 1.0 μm

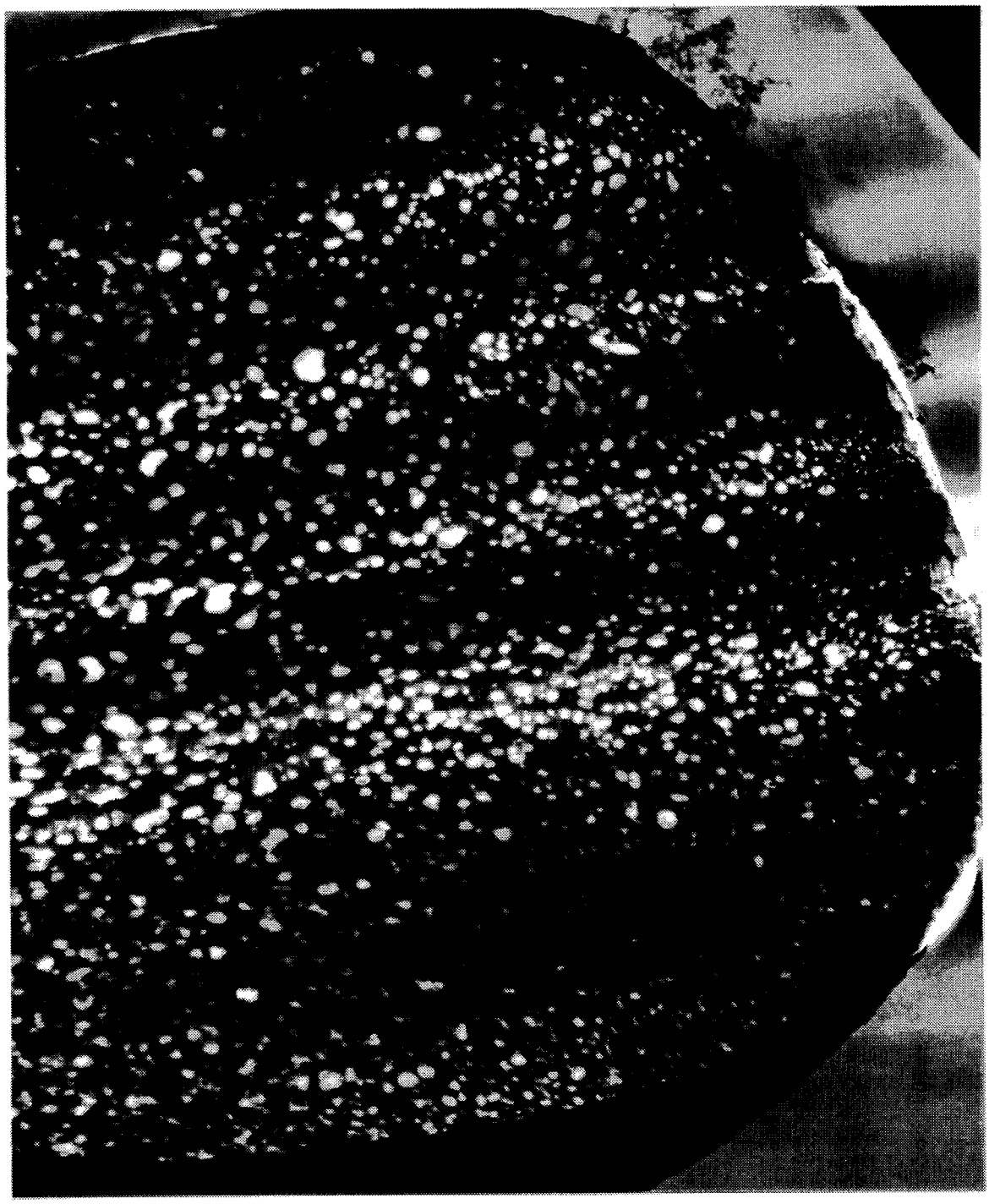
FIG. 12 1.0 μm

MULTICONSTITUENT FIBERS, AND NONWOVEN STRUCTURES OF SUCH FIBERS

This application is a continuation of application Ser. No. 08/047,407, filed Apr. 19, 1993, now abandoned.

BACKGROUND OF THE INVENTION

1. Field of the Invention

The present invention relates to medical fabrics which are gamma radiation resistant, and to multiconstituent fibers for the preparation of such fabrics.

2. Description of Background and Other Information

An objective, in the nonwoven fabrics industry, is to produce such fabrics relatively inexpensively, while also satisfying one or more particular criteria. The nonwoven fabrics, such as those prepared by card and bond or spunbonding processes, in particular represent an economical class of fabrics, for the medical and related fields. Polypropylene fibers are conventionally used for preparing nonwoven fabrics, such as by the foregoing processes, due to the ability of polypropylene to thermally bond over a broad temperature range, and because polypropylene fiber can be carded into light webs at high speeds. However, exposure to gamma radiation causes considerable mechanical property deterioration to polypropylene; not only is such deterioration effected upon an exposure, but the deterioration from that exposure even continues, over the course of time. Gamma radiation treatment is a preferred method of sterilization in the medical and related fields, and is customarily used for all manner of medical fabrics and materials, including surgical and protective items. For this reason, polypropylene is disadvantageous for medical and related applications.

Like polypropylene, polyethylene is also a relatively inexpensive polyolefin. Polyethylenes have yet additional advantages, as set forth below.

For instance, in contrast to the polypropylenes, as discussed above, polyethylenes generally do not undergo extensive deterioration upon exposure to the dosages of gamma radiation which are employed for sterilizing medical items. Polyethylene fabrics have other favorable attributes, including soft hand, good drape, and heat sealability to polyethylene films; yet additionally, polyethylene is also widely recognized for its relative chemical inertness, especially its resistance to acidic or alkaline conditions, in comparison with polyester or nylon fibers.

However, melt spun polyethylene is rarely considered as a thermal bonding fiber, because it lacks the strong bonding property generally attainable with polypropylene fiber, and because of its lower fiber tensile strength. Polyethylene forms fibers which are slick, and of low modulus—generally, lower modulus than that of other types of staple fiber. Foremost among the difficulties normally encountered, in the production of thermally bonded polyethylene fabrics are the problems associated with carding the fibers—by virtue of their being slick and of low modulus, as indicated—and their lack of a broad thermal bonding window. Usually, polyethylene sticks to the calender roll before significant bonding can be achieved.

There is discussion, in the art, of 100% linear low density polyethylene fiber characterized by good bonding behavior. However, in such instances, the foregoing problems are avoided by handcarding the fibers, and bonding them at very slow rates.

Multiconstituent fibers having polyethylene as the continuous phase, with polypropylene dispersed therein, are known in the art. U.S. Pat. No. 4,634,739 (VASSILATOS '739,), and U.S. Pat. No. 4,632,861 (VASSILATOS '861, a division of VASSILATOS '739), disclose improvements to high pressure low density polyethylene (LDPE), obtained by the incorporation of polypropylene; however, the high pressure low density polyethylene, as disclosed in these two patents, is unsuitable for the preparation of a cardable, thermal bonding fiber.

U.S. Pat. No. 4,839,228 (JEZIC et al. '228), U.S. Pat. No. 5,133,917 (JEZIC et al. '917, a continuation of JEZIC et al. '228), disclose linear low density polyethylene (LLDPE) in combination blend with polypropylene, but with the blends obtained by use of a dynamic shear mixer, the use of which necessitates intimate dispersion, and, accordingly, domains of correspondingly small size. In this regard, these patents make particular reference to polyethylene fibrils dispersed in polypropylene fiber, with the diameter of fibrils near the fiber center indicated to be in the range of 350–500 angstroms (0.035–0.05 microns), and the diameter of the more populous fibrils, near the periphery of the fiber, being on the order of about 100–200 angstroms (0.01–0.02 microns).

Preparation of multiconstituent fibers, and of medical garments from such fibers, is likewise known in the art. U.S. Pat. No. 5,108,827 (GESSNER) discloses multiconstituent fibers, comprising a dominant continuous polymer phase and one or more discontinuous phases, with the former having a melting point substantially higher than that of the discontinuous phase polymer or polymers; GESSNER additionally teaches that fabrics prepared, from the multiconstituent fibers disclosed therein, are suitable for a variety of purposes, including use in medical garments.

However, GESSNER does not teach multiconstituent fibers with a polyethylene continuous phase. Further, GESSNER likewise teaches intensive mixing, and, therefore, the polymer domains which result must be correspondingly small, as is the case with the above-indicated JEZIC et al. patents.

It has been discovered that multiconstituent fibers which comprise a dominant continuous linear low density polyethylene phase and at least one discontinuous phase of poly(propylene-co-ethylene) copolymer and/or polypropylene—where the polymers are provided in the proper proportions, and where the one or more discontinuous phases are dispersed in domains of the requisite size—retain both the relatively strong bonding properties and cardability which characterize polypropylene, and also the indicated favorable attributes of polyethylene. Particularly, it has been discovered that fabrics prepared from such fibers have sufficient of the gamma radiation resistance and thermal bond strength which characterizes polyethylene, to render them suitable for medical and related applications.

SUMMARY OF THE INVENTION

The invention pertains to a gamma radiation resistant medical fabric, comprising multiconstituent fibers. These multiconstituent fibers comprise a dominant continuous phase comprising at least one linear low density polyethylene, and at least one discontinuous phase, which comprises at least one polymer selected from the group consisting of poly(propylene-co-ethylene) copolymers and polypropylene.

The at least one discontinuous phase is dispersed through the continuous phase in the form of domains. Preferably, at least about 70 percent by weight of the at least one discontinuous phase is provided as domains of less than about 0.5 microns in diameter, and/or a majority by weight, of the at least one discontinuous phase, comprises domains having an average diameter of between about 0.08 and about 0.12 microns.

Also as a matter of preference, the melting point, of the at least one linear low density polyethylene, is the same, or approximately the same, or lower than, the melting point of at least one—and, most preferably, each—of the discontinuous phase polymers. Specifically, it is preferred that none of the discontinuous phase polymers has a melting point lower than that of the at least one linear low density polyethylene.

The at least one discontinuous phase preferably comprises between about 10 percent and about 45 percent by weight of the fibers. The dominant continuous polyethylene phase preferably comprises between about 55 percent and about 90 percent by weight of the fibers.

In a preferred embodiment, the at least one discontinuous phase comprises an isotactic polypropylene. Also as a preferred embodiment, the at least one discontinuous phase comprises a poly(propylene-co-ethylene) copolymer.

Particularly preferred fibers of the invention include biconstituent fibers, of linear low density polyethylene and isotactic polypropylene, and biconstituent fibers, of linear low density polyethylene and poly(propylene-co-ethylene) copolymer. Also particularly preferred are multiconstituent fibers of linear low density polyethylene, poly(propylene-co-ethylene) copolymer, and isotactic polypropylene.

The invention further pertains to nonwoven fabrics or structures comprising multiconstituent fibers of the invention. Particularly, the invention pertains to nonwoven fabrics and structures—thusly comprising a dominant continuous linear low density polyethylene phase and at least one interdispersed discontinuous phase selected from poly(propylene-co-ethylene) copolymers and polypropylene which are of particular machine directional strength and cross directional strength.

Preferably, such nonwoven structures have a normalized machine directional strength of about 2,200 grams per inch, for a 40 gram per square yard fabric, and a cross directional strength of at least about 400 g/in., and, after receiving a gamma radiation dosage of at least about 60 kGy, retain at least about 60 percent of its machine directional strength prior to receiving the gamma radiation dosage. More preferably, these structures have a cross directional strength of at least about 500 g/in., and, after receiving a gamma radiation dosage of at least about 60 kiloGray units (kGy), retain at least about 70 percent of its machine directional strength prior to receiving the gamma radiation dosage.

Also as a matter of preference, the fabrics or structures of the invention are prepared by the card and bond method.

BRIEF DESCRIPTION OF THE DRAWINGS

FIGS. 1–12 are photomicrographs of cross-sections of various fibers. Specifically, FIGS. 1, 2 and 4 are photomicrographs of cross-sections taken from $RuO_4$-stained fibers of each of Examples 1–3, respectively, enlarged 10,000 times. FIGS. 3 and 5 are photomicrographs of cross-sections taken from $RuO_4$-stained fibers of each of the indicated Examples 2 and 3, respectively, enlarged 150,000 times.

Figure 1:
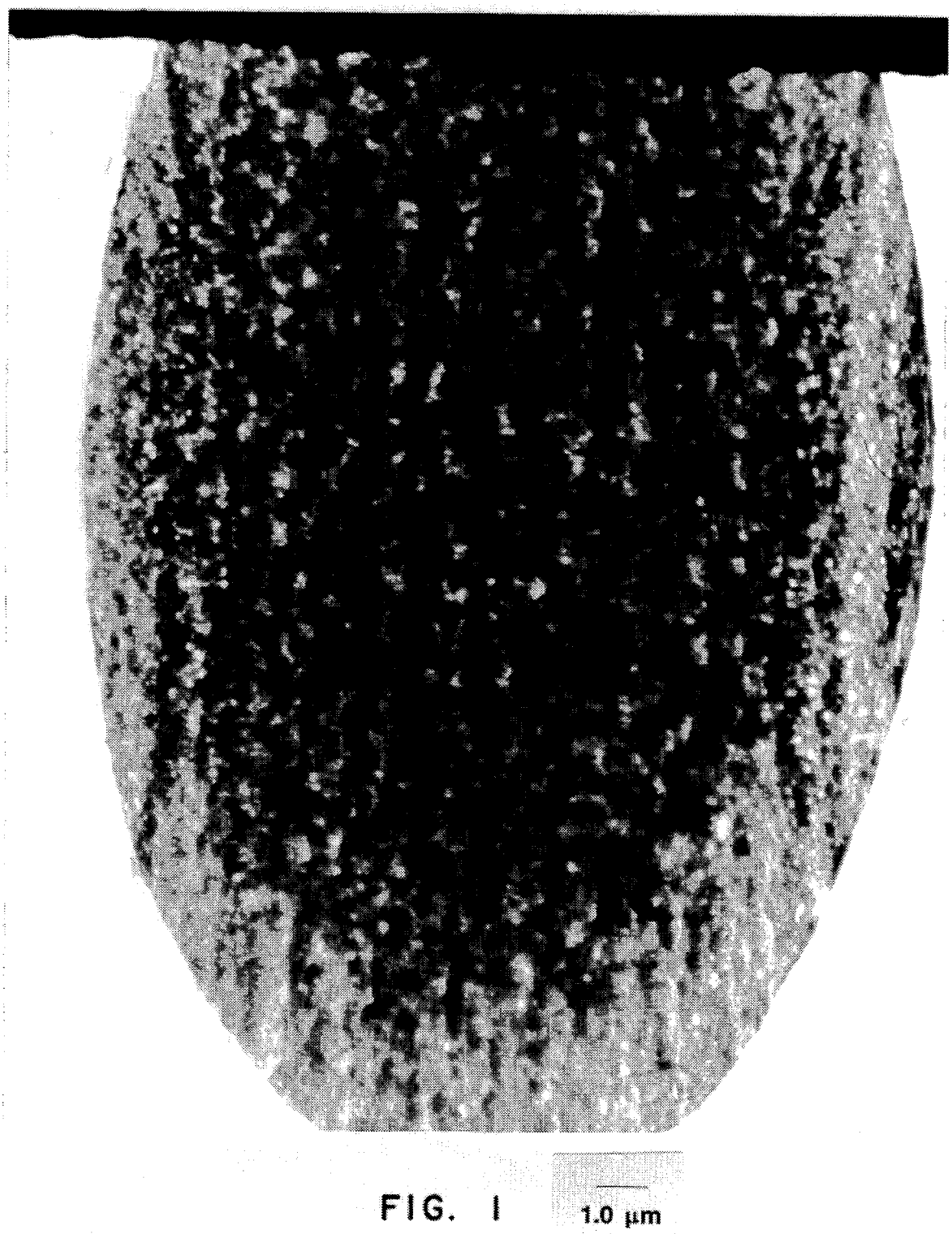

The fibers of Examples 1 and 2 are multiconstituent (biconstituent) fibers of this invention having a continuous phase polymer of LLDPE and a discontinuous phase polymer of polypropylene/6% polyethylene. Accordingly, FIG. 1, which depicts the fiber of Example 1, and FIGS. 2 and 3, which depict the fiber of Example 2 at different magnifications, all show fibers of the invention.

Example 3 is directed to 100% of continuous phase LLDPE and is outside the scope of this invention. Accordingly, FIGS. 4 and 5, which depict the fiber of Example 3 at different magnifications, both show a fiber outside the scope of the invention.

FIGS. 6–12 are photomicrographs of cross-sections taken from $RuO_4$-stained fibers of each of Examples 5–11, respectively, enlarged 15,000 times. The fibers of Examples 5–11 are multiconstituent fibers of the invention having polymer LLDPE as the continuous phase and the discontinuous phase of each is described in Tables 1 and 2; accordingly, FIGS. 6–12 all show fibers of the invention.

DESCRIPTION OF THE INVENTION

The term "gamma radiation resistant", as used herein in conjunction with the medical fabrics of the invention, refers to the ability to endure gamma radiation treatment sufficient to sterilize such fabrics for their intended medical applications, without causing the degree of mechanical property deterioration which will render the fabrics unsuitable for these applications. In this regard, typical sterilization dosages of gamma radiation will cause some deterioration of properties. A typical dosage is about 30 kiloGray units (kGy); moreover, on occasion, items may be, and often are, resterilized by exposure to a second 30 kGy dosage. The term "dominant" as used herein, refers to the amount of the polymer providing the continuous phase, of the multiconstituent fibers of the invention, relative to the amount of the one or more discontinuous phase polymers. In this regard, the matter of which polymers form the continuous and discontinuous phases, in a multiple polymer continuous/discontinuous phase composition—such as a multiconstituent fiber—depends upon the identities, and upon the relative proportions, of the polymers; the dominant continuous phase, of the present invention, is accordingly understood as having an amount of the dominant continuous phase polymer, relative to the amount of the one or more discontinuous phase polymers, so that the former is maintained as the dominant continuous phase, with the latter dispersed therein as one or more discontinuous phases, in the form of domains. The multiconstituent fibers of the invention preferably comprise a dominant continuous phase, comprising one or more linear low density polyethylenes (LLDPE), with one or more additional polymers, provided as at least one discontinuous phase which is dispersed, in the form of domains, in the linear low density polyethylene phase. Suitable polymers for the indicated one or more discontinuous phases include poly(propylene-co-ethylene) copolymers, and polypropylenes; yet other polyolefins, including those which are predominantly immiscible with linear low density polyethylene, and correspondingly form discrete domains, may also be included.

The indicated at least one linear low density polyethylene preferably has a melting point which is no higher than the melting point for each of the one or more discontinuous phase polymers; specifically, where one or more poly(propylene-co-ethylene) copolymers are present, the polyethylene melting point generally will be the same as, or lower than, the copolymer melting point, while, with regard to polypropylene, the polyethylene melting point will generally be lower than that of the polypropylene. The polymers of all the phases are preferably thermoplastic.

Also as a matter of preference, each of the discontinuous phase polymers is immiscible, or at least substantially immiscible, with the linear low density polyethylene. Where there are two or more discontinuous phase polymers, they may be immiscible with one another, or miscible, to a greater or lesser degree.

Where there are two discontinuous phase polymers present, and they are mutually immiscible, then each such discontinuous phase polymer is provided as a separate discontinuous phase; however, where the multiple discontinuous phase polymers are miscible in some degree, then they may be present as a common discontinuous phase, to the extent of the miscibility. This can be a factor in the situation of polypropylenes and poly(propylene-co-ethylene) copolymers being present as discontinuous phase polymers.

In this regard, it is further noted that, the presence of poly(propylene-co-ethylene) copolymer, characterized by an ethylene content of about 6 percent by weight or less, and having a lower melting point and crystallization temperature than the polypropylene, promotes some degree of miscibility between the polyethylene and polypropylene, when all three are present. Such a polymer configuration of the invention, in which the discontinuous phase domains have some degree of miscibility with the continuous phase, appears to be desirable, with respect to balancing thermal bond capability with gamma radiation resistance.

Specifically, the less the ethylene content of the poly(propylene-co-ethylene) copolymer, the more its similarity in properties and behavior, to polypropylene, and, accordingly, the greater its miscibility therewith. Correspondingly, the closer two poly(propylene-co-ethylene) copolymers are in ethylene content, the greater their similarities, and, therefore miscibility—where, in the fiber of the invention, the discontinuous phase polymers include at least two different poly(propylene-co-ethylene) copolymers.

In view of the foregoing, the use of both polypropylene, and one or more poly(propylene-co-ethylene) copolymers, would appear to be useful as a means, for controlling the immiscibility between continuous and discontinuous phases, beyond varying the viscosities of the discontinuous phases.

Suitable linear low density polyethylenes include Dow 6835, 6811, 61800.15, 61800.03, 61800.13, and 61800.31; these are available from The Dow Chemical Company, Midland, Mich. A particular linear low density polyethylene which is preferred is one having a density of 0.95 g/cc., and a melt index (MI) of 17 dg/minute (weight average molecular weight=50,000 g/mol).

Suitable poly(propylene-co-ethylene) copolymers include those comprising up to about 9 percent by weight ethylene; preferably, the ethylene is randomly distributed in the polymer. A commercially available poly(propylene-co-ethylene) copolymer which may be used is FINA Z9450, from Fina Oil and Chemical Company, Dallas, Tex.

Among the preferred such random poly(propylene-co-ethylene) copolymers are those which are characterized by a low melt flow rate—i.e., about 10 or about 5 dg/minute, or lower and are stabilized with one or more antioxidants and/or hindered amine light stabilizer. Particularly preferred such low melt flow rate, highly stabilized poly(propylene-co-ethylene) copolymers are those with a melt flow rate of about 5 dg/minute (weight average molecular weight=275,000 g/mol), and comprising 6% ethylene, by weight; also particularly preferred are poly(propylene-co-ethylene) copolymers with lower ethylene contents—e.g., 3% ethylene, by weight.

Suitable polypropylenes (PP) include the atactic, syndiotactic, and isotactic polypropylenes; of these, the isotactic polypropylenes are preferred. Particularly preferred isotactic polypropylenes are those having a melt flow rate of not more than 40, or about 40, dg/minute. Commercially available isotactic polypropylenes which may be used include Himont PH011, P165, and P128, from Himont U.S.A., Inc., Wilmington, Del., and Amoco 4 MFR and 9 MFR pellets, from Amoco Chemical Company, Chicago, Ill.

The linear low density polyethylenes, poly(propylene-co-ethylene) copolymers, and polypropylenes which may be used, in the present invention, include those as disclosed in GESSNER, VASSILATOS '739, VASSILATOS '861, JEZIC et al. '228, and JEZIC et al. '917, and in U.S. Pat. No. 3,616,149 (WINCKLHOFER), Japanese Patent Publication No. 3279459, and Japanese Patent Publication No. 59041342; U.S. Pat. No. 4,830,907 (SAWYER et al. '907), U.S. Pat. No. 4,880,691 (SAWYER et al. '691), and U.S. Pat. No. 4,990,204 disclose optimum ranges of properties useful in meltspinning linear low density polyethylenes. These patents and publications are incorporated herein in their entireties, by reference thereto.

As to suitable combinations of the foregoing polymers, one or more such poly(propylene-co-ethylene) copolymers, or one or more such polypropylenes, or a combination of one or more such poly(propylene-co-ethylene)copolymers and one or more such polypropylenes, can be included as discontinuous phases, in the linear low density polyethylene dominant continuous phase. Accordingly, the multiconstituent fibers of the invention can be, for example, biconstituent fibers of linear low density polyethylene and a poly(propylene-co-ethylene) copolymer, or of linear low density polyethylene and a polypropylene; moreover, the multiconstituent fibers can include, dispersed throughout the polyethylene continuous phase, two or more poly(propylene-co-ethylene) copolymers, or two or more polypropylenes, or one or more of each of such poly(propylene-co-ethylene) copolymers and polypropylenes.

With respect to the relative amounts of the polymers, they are provided in proportions so as to effect the requisite gamma radiation resistance, and continuous/discontinuous phase configuration. With reference to the former parameter, for any discontinuous phase polymer present which is susceptible to gamma radiation degradation—such as polypropylene—the proportion thereof is limited to an amount which will preclude gamma radiation sterilization from rendering the fabric unsuitable for intended applications, especially those in medical and related fields; particularly as to the latter parameter, the polymers are present in proportions which result in the linear low density polyethylene providing the dominant continuous phase, with poly(propylene-co-ethylene) copolymer and/or polypropylene correspondingly being dispersed therethrough as at least one discontinuous phase, in the form of domains; in this regard, the use of a random poly(propylene-co-ethylene) copolymer is an effective means for achieving both adequate domain morphology for carding and thermal bonding, and the requisite retention of fabric strength following gamma radiation sterilization.

As a preferred range, the linear low density polyethylene comprises between about 55 percent and about 90 percent by weight of the fiber; another preferred range, for the linear low density polyethylene, is between about 70 percent and about 80 percent by weight of the fiber. Particular preferred polyethylene proportions are 70 percent, or about 70 percent, and 80 percent, or about 80 percent, by weight of the fiber.

The one or more discontinuous phases preferably total between about 10 percent and about 45 percent, or between about 20 percent and about 30 percent, by weight of the fiber. Particular preferred total proportions, for the at least one discontinuous phase, are 20 percent, or about 20 percent, and 30 percent, or about 30 percent, by weight of the fiber.

One preferred polymer combination, for the multiconstituent fibers, includes linear low density polyethylene having a density of 0.95 g/cc, and a melt index of 17 dg/minute (weight average molecular weight=50,000 g/mol, as the dominant continuous phase, with a discontinuous phase of poly(propylene-co-ethylene) copolymer comprising 6%, or about 6% by weight ethylene, randomly placed, and having a low melt flow rate—preferably, 5, or about 5 dg/minute (weight average molecular weight=275,000 g/mol); this combination may be provided as a biconstituent fiber of these two polymers, or as a multiconstituent polymer, including one or more yet additional polymers. For this combination, the linear low density polyethylene preferably comprises between about 70 percent and about 80 percent of the polymer total, with the poly(propylene-co-ethylene) copolymer, or this copolymer and the one or more additional polymers, providing the remainder; preferably, the indicated one or more additional polymers is an isotactic polypropylene.

The multiconstituent fibers may also incorporate discontinuous phase polymers of higher melting point and/or higher molecular weight. Such polymers include poly(propylene-co-ethylene) copolymers of lower ethylene content, and polypropylene homopolymers.

Besides the polymer proportions being provided so as to effect gamma radiation resistance, the domain size, of the one or more discontinuous phases, is likewise controlled, for the same purpose. Specifically, the domains of the discontinuous phase or phases are of a size—preferably are at or below a certain size—so that degradation of the discontinuous phase polymer or polymers, by gamma radiation, will not correspondingly sufficiently affect the overall properties, of the fabric as a whole, to prevent the fabric from being gamma radiation resistant, within the meaning set forth herein.

Accordingly, the multiconstituent fibers of the invention are preferably prepared so that at least about 70 percent by weight, of the at least one discontinuous phase, is present in the form of domains having a diameter of between about 0.05 and about 0.3 microns. Alternatively, or in addition, the multiconstituent fibers of the invention are prepared so that a majority by weight, of the at least one discontinuous phase, comprises domains having an average diameter of between about 0.08 and about 0.12 microns.

One factor affecting domain size is the amount of mixing to which the polymers are subjected, in the preparation of the multiconstituent fibers; in this regard, the greater the degree of mixing, the smaller will be the domain size of the one or more discontinuous phases. The requisite degree of mixing, for obtaining the domain size necessary to meet the objectives of the present invention, can be readily determined by those of ordinary skill in the art, without undue experimentation.

The multiconstituent fibers, of the present invention, may be prepared by conventional techniques, with the use of conventional equipment. Initially, the polymers may be mechanically blended, or both blended and melted, before being fed to the extruder; alternatively, they can simply be fed to the extruder—for example, by gravity feed of polymer pellets without such prior blending or blending and melting.

In the extruder, the polymers are subjected to blending, melting, and heating; they are then extruded therefrom, in the form of filaments. These filaments are subjected to the requisite stretching and crimping, then cut to obtain staple fibers. The resulting staple fibers can be used to prepare nonwoven fabrics or structures of the invention. In this regard, such fibers can be made into webs, preferably by carding; further, any of the other known commercial processes, including those employing mechanical, electrical, pneumatic, or hydrodynamic means for assembling fibers into a web—e.g., airlaying, carding/hydroentangling, wetlaying, hydroentangling, and spunbonding (i.e., meltspinning of the fibers directly into fibrous webs, by a spunbonding process)—can also be appropriate for this purpose.

The thusly prepared webs are bonded, to prepare the fabrics or structures of the invention, preferably by calendering. Appropriate calendering means include a diamond patterned embossed (about 15 to 25 percent land area) roll and a smooth roll; roll embossments other than a diamond shape may also be used. Other thermal and sonic bonding techniques, like through-air and ultrasonic bonding, may also be suitable.

Fibers of the invention may be suitably cut and used as binder fibers, and may additionally be used as continuous filaments in knitting and weaving operations.

Nonwoven fabrics or structures of the invention are suitable for a variety of uses, including, but not limited to, coverstock fabrics, disposable garments, filtration media, face masks, and filling materials. In accordance with the previous discussion, concerning the gamma radiation resistance of the fibers of the invention, they are particularly suitable for materials intended for sterilization by such radiation treatment.

Accordingly, the fabrics or structures of the invention are particularly suitable for medical, hygienic, and related applications, especially where sterilization by gamma radiation treatment is intended. Suitable examples include medical and surgical drapes and clothing, and clean room garments.

The fabrics or structures of the invention may further be used as substrates for fabrics which are extrusion-coated with thin layers of polyethylene film, and which are capable of functioning as radiation resistant barrier fabrics. In this context, "barrier" pertains to imperviousness to transport of liquids through the fabric, such liquids including blood, alcohol, water, and other solvents which are not corrosive to polyethylene.

The invention is illustrated in the following procedures, which are provided for the purpose of representation, and are not to be construed as limiting the scope of the invention. Unless stated otherwise, all percentages, parts, etc. are by weight.

Several fibers and fabrics, including those of the invention, were prepared, using polymers identified as A–M in the following Table 1, and having the properties indicated therein. Consistent with the information provided in Table 1, polymers A, B, H, J, K, and L are linear low density polyethylene, polymer C is linear isotactic poly(propylene-co-ethylene) copolymer, and polymers D, E, F, G, and M are isotactic polypropylene homopolymers; polymer I, which is DMDA 8920, from Union Carbide Chemicals and Plastics Co., Inc., Polyolefins Div., Danbury, Conn., is a low pressure high density polyethylene (HDPE).

Except for polymers G and M, all of these polymers were initially provided in the form of pellets. Polymers G and M were provided as "flake" resin.

TABLE 1

| | Polymer | Type | Density[1] g/cm$^3$ | Melt[2] Index dg/min | Melt[3] Flow dg/min | Melting Point Range (°C.) |
|---|---|---|---|---|---|---|
| A | Dow 6835 | LLDPE | .950 | 17 | — | 120–128 |
| B | Dow 6811 | LLDPE | .940 | 27 | — | 120–126 |
| C | Fina Z9450 | PP/6% PE | .892 | — | 5 | 120–130 |
| D | Himont PH011 | PP | .905 | — | 20 | 160–165 |
| E | Amoco 4 MFR | PP | .905 | — | 4 | 160–165 |
| F | Amoco 9 MFR | PP | .905 | — | 9 | 160–165 |
| G | Himont P165 | PP | .905 | — | 10 | 160–165 |
| H | Dow 61800.15 | LLDPE | .935 | 12 | — | 120–128 |
| I | Union Carbide DMDA 8920 | HDPE | .96 | 20 | — | 135 |
| J | Dow 61800.03 | LLDPE | .935 | 40 | — | 120–126 |
| K | Dow 61800.13 | LLDPE | .930 | 18 | | 120–126 |
| L | Dow 61800.31 | LLDPE | .930 | 150 | — | 116–122 |
| M | Himont P128 | PP | .905 | — | 13 | 160–165 |

[1]ASTM D792
[2]ASTM 1238.190° C.
[3]ASTM 1238.230° C.

The fibers of Examples 1–30 were prepared according to a two step or a one step process, using the polymers identified in Table 2, in the indicated proportions. The fibers and nonwoven structures of Examples 1, 2, 5–12, and 20–30 are of the invention; of these, the continuous phase for both Examples 21 and 22 includes two polyethylenes—polymers A and L, provided in the indicated amounts.

Examples 3, 4, and 14–19 serve as controls, consisting of 100 percent polyethylene; Example 13 serves as a control consisting of 100 percent polypropylene.

Figure 2:
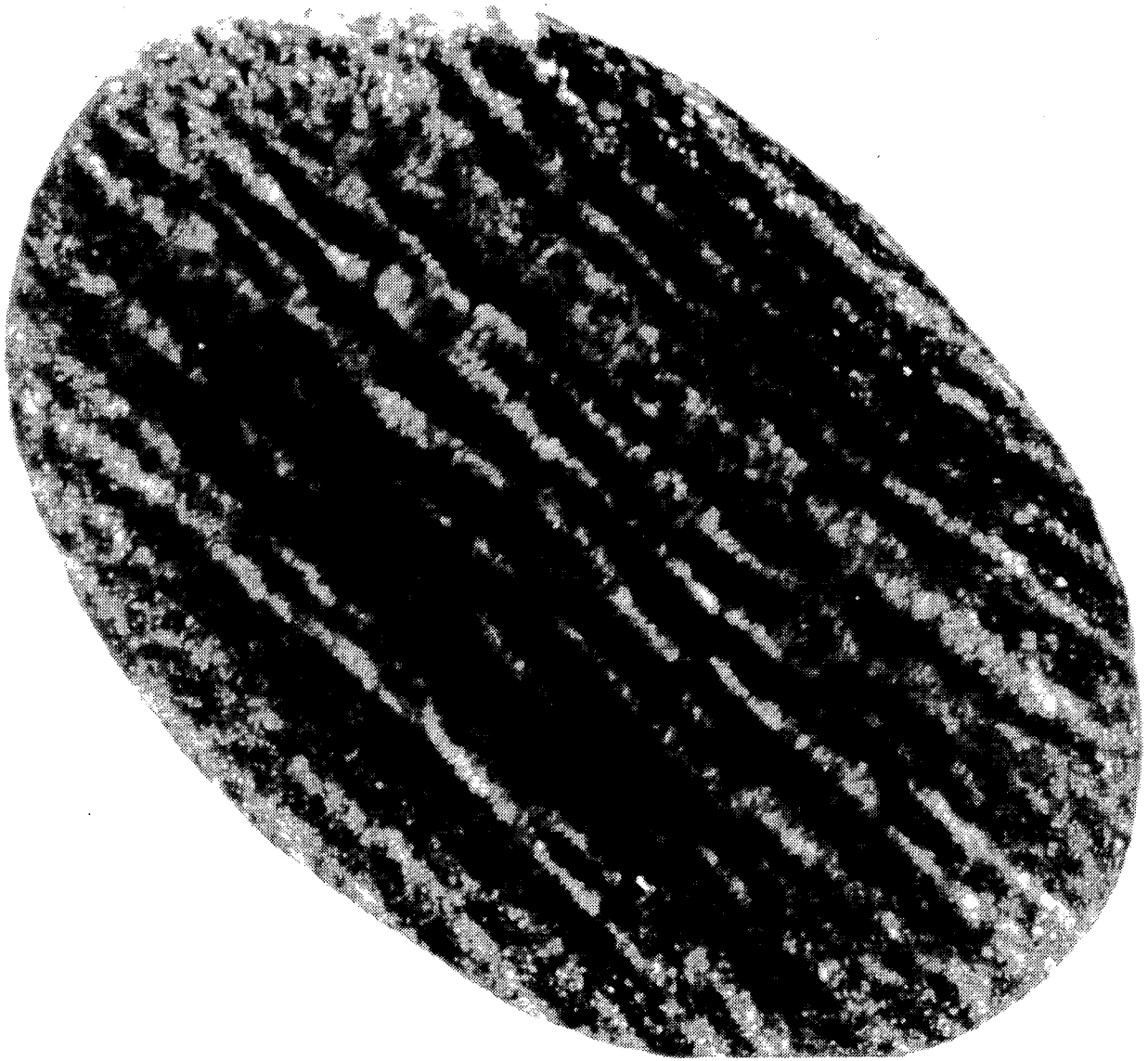
Figure 3:
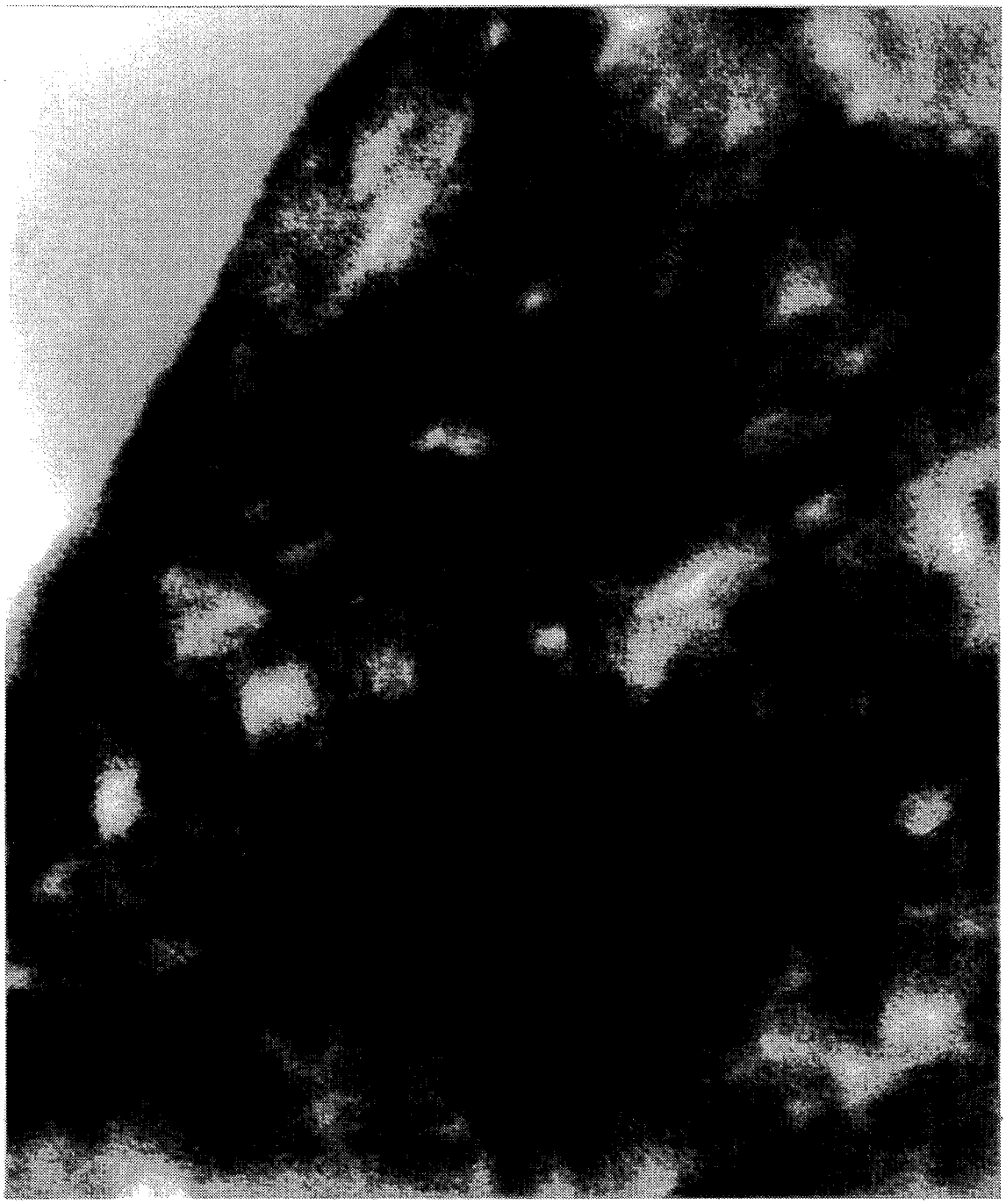
Figure 4:
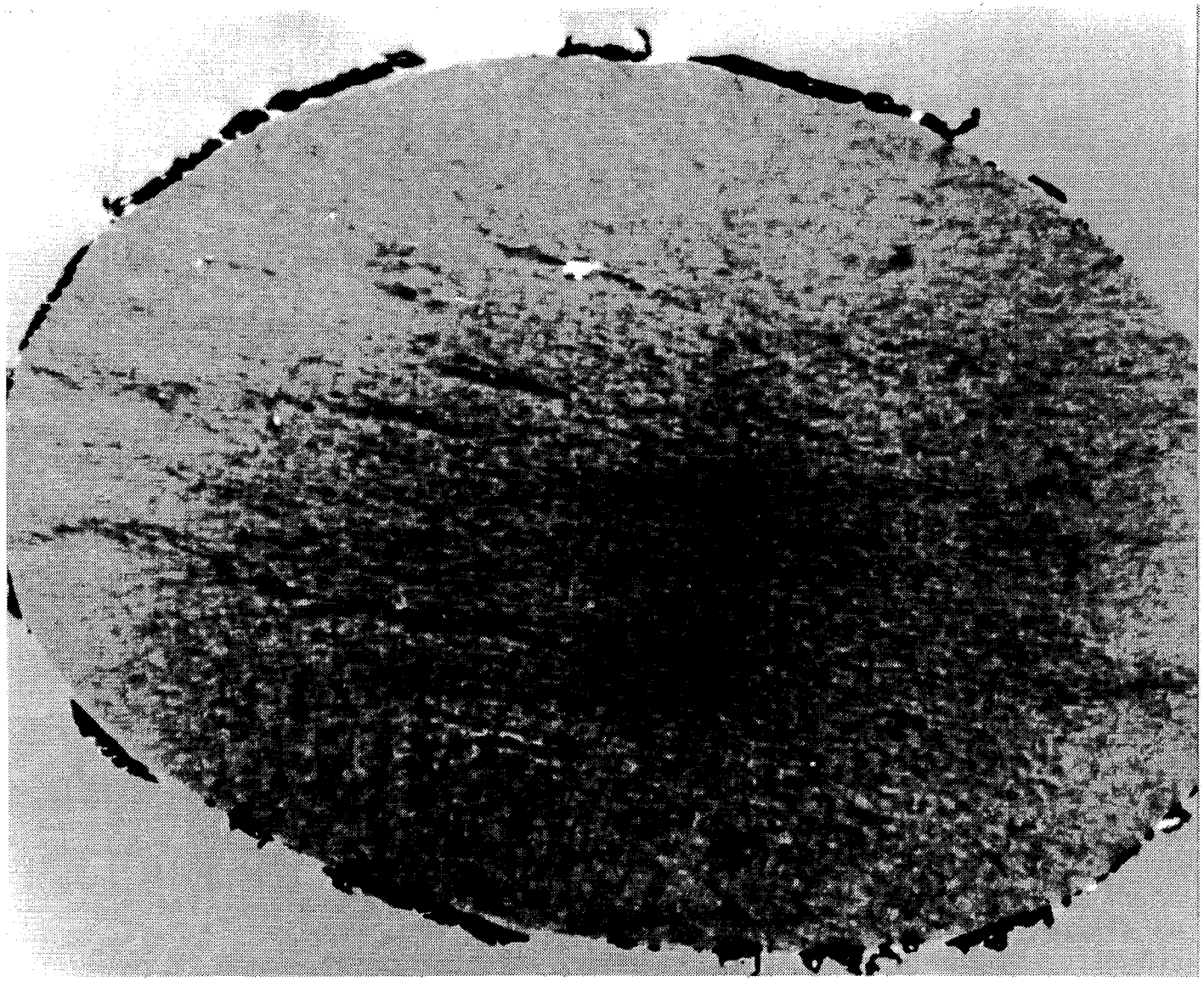
Figure 5:
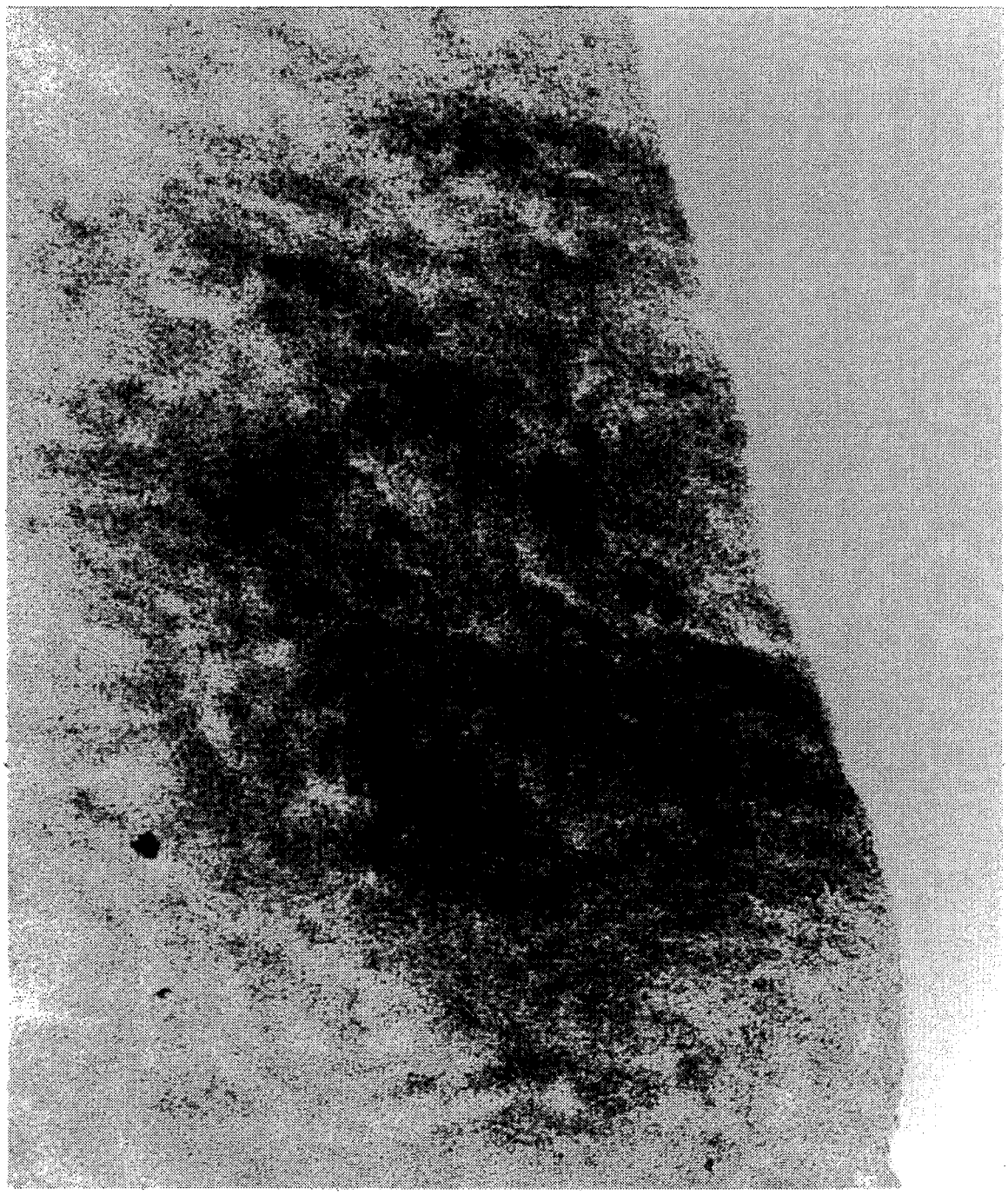
Figure 6:
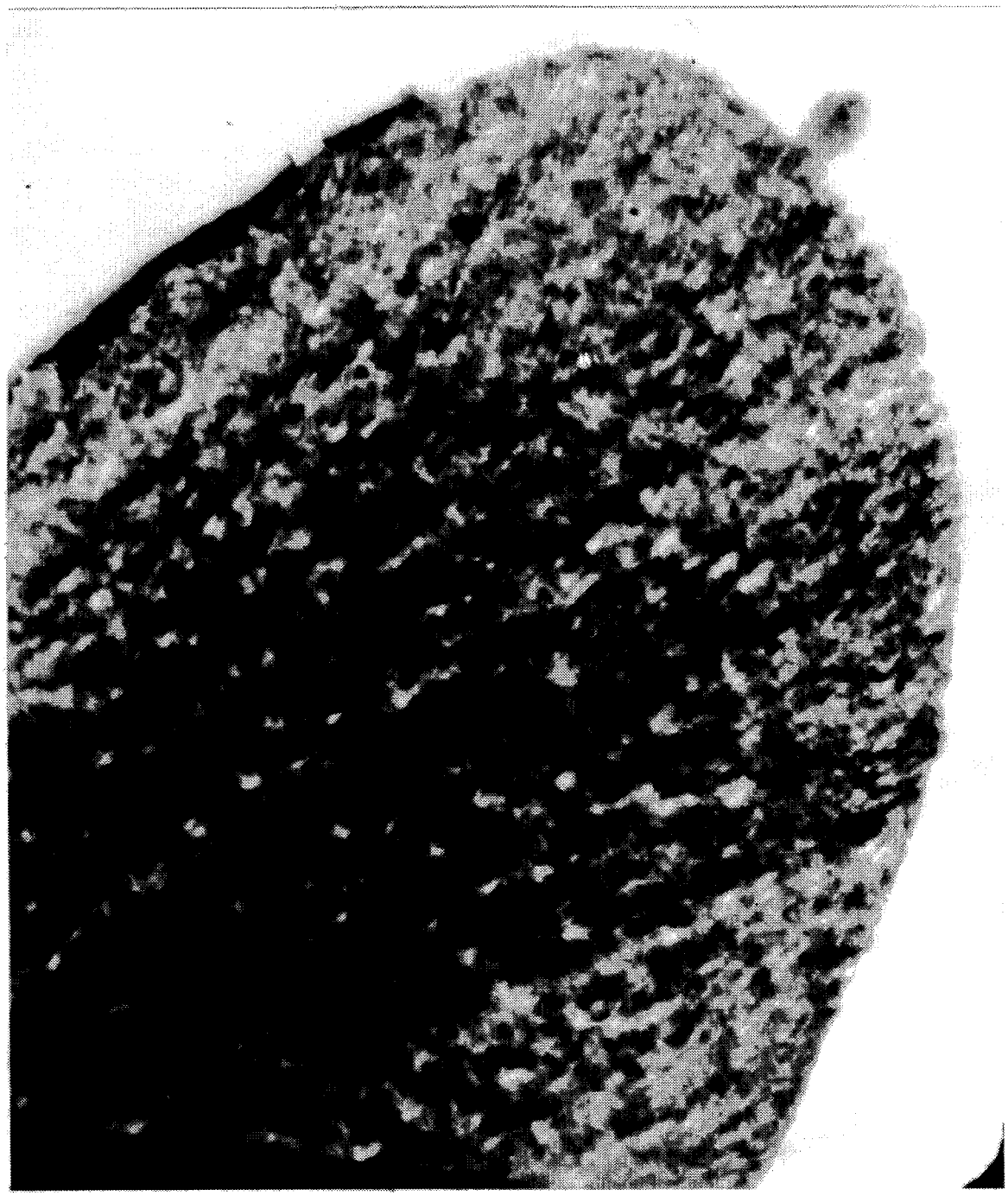
Figure 7:
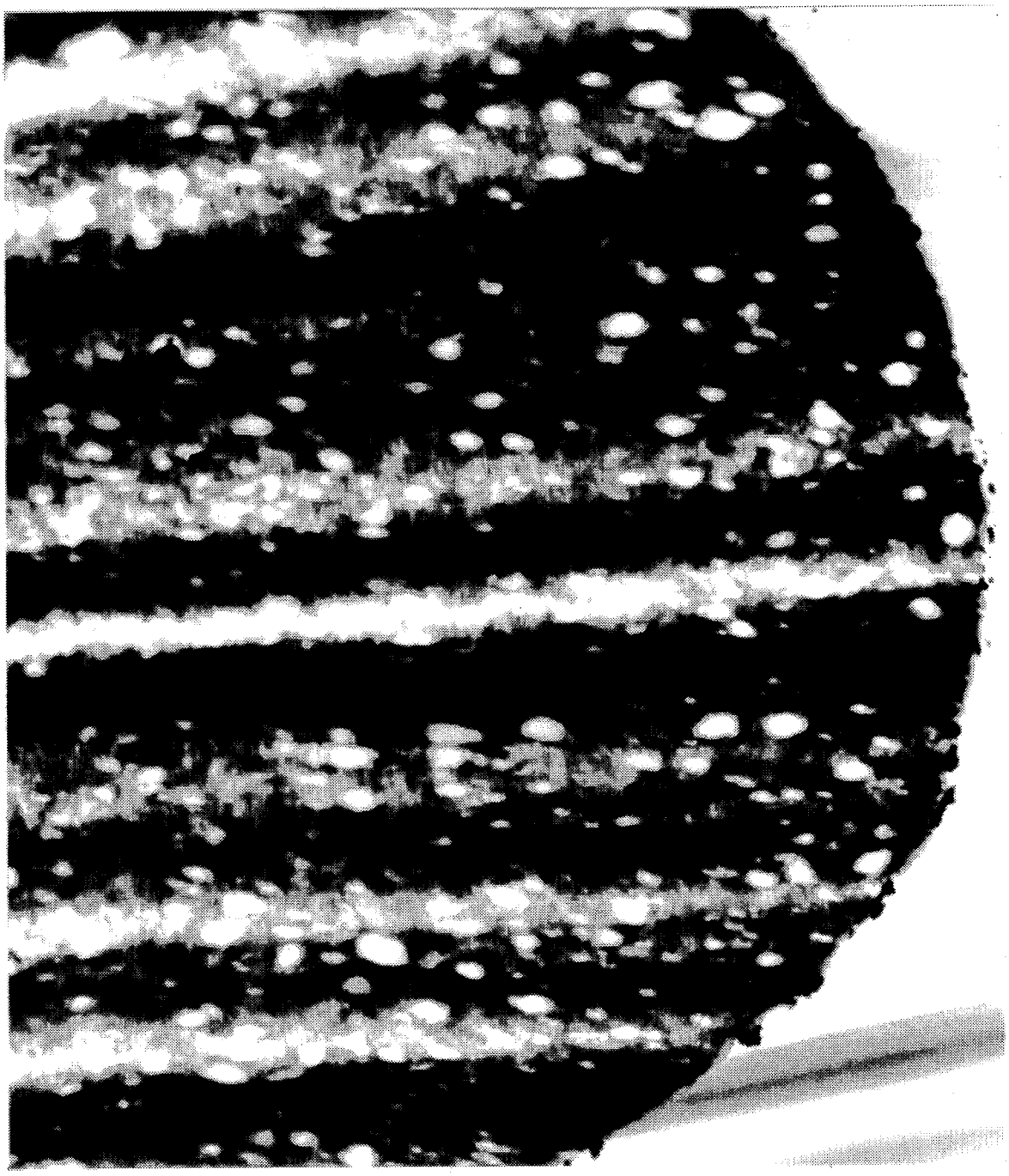

Photomicrographs were taken of fibers from certain of Examples 1–30. Specifically, FIGS. 1, 2, and 4 are photomicrographs of cross-sections taken from $RuO_4$-stained fibers of each of Examples 1–3, respectively, enlarged 10,000 times, while FIGS. 3 and 5 are photomicrographs of cross-sections taken from $RuO_4$-stained fibers of each of Examples 2 and 3, respectively, enlarged 150,000 times; FIGS. 6–12 are photomicrographs of cross-sections taken from $RuO_4$-stained fibers of each of Examples 5–11, respectively, enlarged 15,000 times.

The $RuO_4$ staining was conducted according to the technique disclosed in TRENT et al., *Macromolecules,* Vol. 16, No. 4, 1983, "Ruthenium Tetroxide Staining of Polymers for Electron Microscopy" which is incorporated in its entirety, by reference thereto.

TABLE 2

| Example | Continuous Phase Polymer | % | Discontinuous Phase Polymer | % | Second Discontinuous Phase Polymer | % | Process |
|---|---|---|---|---|---|---|---|
| 1 | A | 80 | C | 20 | — | — | 2 Step |
| 2 | A | 70 | C | 30 | — | — | 2 Step |
| 3 | A | 100 | — | — | — | — | 2 Step |
| 4 | A | 100 | — | — | — | — | 1 Step |
| 5 | A | 80 | C | 7.5 | D | 12.5 | 1 Step |
| 6 | A | 80 | C | 7.5 | E | 12.5 | 1 Step |
| 7 | A | 80 | C | 7.5 | F | 12.5 | 1 Step |
| 8 | A | 80 | C | 20 | — | — | 1 Step |
| 9 | A | 55 | D | 45 | — | — | 1 Step |
| 10 | A | 65 | C | 13 | F | 22 | 1 Step |
| 11 | A | 80 | E | 20 | — | — | 1 Step |
| 12 | A | 70 | C | 30 | — | — | 1 Step |
| 13 | G | 100 | — | — | — | — | 2 Step |
| 14 | K/I | 60/40 | — | — | — | — | 2 Step |
| 15 | H | 100 | — | — | — | — | 2 Step |
| 16 | H | 100 | — | — | — | — | 2 Step |
| 17 | H | 100 | — | — | — | — | 2 Step |
| 18 | H/I | 80/20 | — | — | — | — | 2 Step |
| 19 | J | 100 | — | — | — | — | 2 Step |
| 20 | B | 80 | — | 20 | — | — | 2 Step |
| 21 | A/L | 62/15 | C | 23 | — | — | 2 Step |
| 22 | A/L | 62/15 | C | 23 | — | — | 2 Step |
| 23 | A | 80 | D | 20 | — | — | 2 Step |
| 24 | B | 70 | C | 10 | D | 20 | 2 Step |
| 25 | B | 70 | C | 10 | D | 20 | 2 Step |
| 26 | A | 85 | D | 15 | — | — | 2 Step |
| 27 | A | 70 | D | 30 | — | — | 2 Step |
| 28 | A | 75 | D | 20 | M | 4 | 2 Step |

TABLE 2-continued

| Example | Continuous Phase Polymer | % | Discontinuous Phase Polymer | % | Second Discontinuous Phase Polymer | % | Process |
|---|---|---|---|---|---|---|---|
| 29 | A | 83 | M | 17 | — | — | 2 Step |
| 30 | A | 75 | D | 20 | M | 5 | 2 Step |

As noted in Table 2, the fibers of Examples 1–3 and 13–30 were prepared from the two step process. In the first step, compositions were prepared by tumble mixing blends of the specified polymers. In certain of these two step process Examples, 100 percent polyethylene (either 100 percent LLDPE, or LLDPE blended with HDPE), without polypropylene or poly (propylene-co-ethylene) copolymers, were processed, to serve as controls.

The process conditions, used in the two step process to prepare the fibers of Examples 1–3 and 13–30, are set forth in Table 3 below.

TABLE 3

| Example | Spin Temp. (°C.) | Take-up Rate (m/min.) | Fineness Spinyarn (dtex) | Draw Ratio (x) | Fineness Staple (dtex) | Cut Length (mm) |
|---|---|---|---|---|---|---|
| 1 | 220 | 400 | 5.7 | 2.5 | 3.5 | 48 |
| 2 | 260 | 400 | 5.9 | 2.5 | 3.5 | 48 |
| 3 | 205 | 650 | 3.9 | 2.7 | 1.8 | 48 |
| 13 | 300 | 900 | 2.9 | 1.4 | 2.4 | 38 |
| 14 | 230 | 305 | 4.2 | 2.6 | 3.0 | 38 |
| 15 | — | — | — | — | 2.3 | 62 |
| 16 | 230 | 600 | 4.4 | 3.0 | 1.7 | 38 |
| 17 | — | — | — | — | — | — |
| 18 | 225 | 400 | 5.1 | 1.5 | 4.4 | 48 |
| 19 | 230 | 400 | 6.6 | 3.0 | 3.3 | 48 |
| 20 | 220 | 450 | 5.0 | 2.5 | 2.6 | 48 |
| 21 | 205 | 450 | 5.0 | 2.1 | 3.3 | 48 |
| 22 | 205 | 450 | 5.0 | 3.2 | 2.4 | 48 |
| 23 | 220 | 300 | 14.6 | 2.5 | 7.4 | 48 |
| 24 | 220 | 300 | 12 | 3.7 | 5.5 | 48 |
| 25 | 220 | 400 | 8 | 3.7 | 4.2 | 48 |
| 26 | 230 | 400 | 7.2 | 2.7 | 3.3 | 48 |
| 27 | 230 | 400 | 7.2 | 2.7 | 3.3 | 48 |
| 28 | 230 | 300 | 8.8 | 3.0 | 3.3 | 48 |
| 29 | 230 | 300 | 8.8 | 3.0 | 3.3 | 48 |
| 30 | 230 | 300 | 8.8 | 3.0 | 3.3 | 48 |

Particularly as to Example 1, in the first step, the pellet mixture was gravity fed into an extruder, then heated, extruded and spun into a circular cross section multiconstituent fiber, at a melt temperature of about 205 to 220° C. Prior to melting, at the feed throat of the extruder, the mixture was blanketed with nitrogen.

The melt was extruded through a standard 675 hole extrude, at a rate of 400 meters per minute, to prepare spin yarn of 5.7 decitex (dtex), (5.0 denier per filament). The fiber threadlines in the quench box were exposed to normal ambient air quench (cross blow).

In the second step, the resulting continuous filaments were collectively drawn, using a mechanical draw ratio of 2.5×. The drawn tow was crimped at about 30 crimps per inch (118 crimps per 10 cm) using a stuffer box with steam; as to the Examples generally, the fibers of each example were crimped, so as to have enough cohesion for carding purposes.

During each step, the fibers were coated with a 0.4 to 0.8 weight percent finish mixture (percent finish on fiber by weight), of an ethoxylated fatty acid ester and an ethoxylated alcohol phosphate (from George A. Ghoulston Co., Inc., Monroe N.C., commercially available under the name Lurol PP 912), and cut to 48 mm.

The fibers were then carded into conventional fiber webs at 30.5 meters per minute (100 feet per minute), using equipment and procedures as discussed in Legare, R. J., 1986 TAPPI *Synthetic Fibers for Wet System and Thermal Bonding Applications,* Boston Park Plaza Hotel & Towers, Boston, Mass., Oct. 9–10, 1986, "Thermal Bonding of Polypropylene Fibers in Nonwovens", pages 1–13 and attached Tables and Figures. This article is incorporated herein in its entirety, by reference thereto.

Specifically, three-ply webs, generally, of staple were identically oriented and stacked (primarily in the machine direction), and bonded—using a diamond design embossed calender roll and a smooth roll, at roll temperatures ranging from 127 to 140° C., and roll pressures of 420 Newtons per linear centimeter (240 pounds per linear inch)—to obtain test nonwoven structures, weighing nominally 48 grams per square meter (40 grams per square yard).

For other two step process Examples, the fibers were run using different ranges of roll temperatures; Table 6 below specifies optimum temperature conditions for the fibers of each Example. In all instances, test strips of the nonwoven structure, 1 inch×7 inches (25 mm×178 mm), were then identically tested, using a tensile tester from Instron Corporation, Canton, Mass., for cross directional (CD) strength and elongation (to break).

As noted in Table 2, the fibers of Examples 4–12 were prepared from the one step process. Initially, compositions of the polymers identified in Examples 4–12 of TABLE 1 were prepared by feeding these polymers at controlled rates, to a common mixing vessel, to effect a blend of the specified polymer combinations.

The process conditions, used in the one step process, to prepare the fibers of Examples 4–12, are set forth in Table 4 below.

TABLE 4

| EXAMPLE | Spin Temp (°C.) | Draw Ratio (x) | Staple (dtex) | Cut Length (mm) |
|---|---|---|---|---|
| 4 | 210 | 2.2 | 4.5 | 48 |
| 5 | 210 | 2.6 | 3.5 | 48 |
| 6 | 210 | 2.6 | 3.5 | 48 |
| 7 | 210 | 2.6 | 3.6 | 48 |
| 8 | 218 | 2.2 | 2.3 | 48 |
| 9 | 220 | 2.2 | 3.5 | 48 |
| 10 | 220 | 2.2 | 2.3 | 48 |
| 11 | 220 | 2.2 | 3.6 | 48 |
| 12 | 207 | 1.7 | 2.5 | 38 |

Particularly as to Example 4, the pellet mixture was gravity fed into an extruder, then heated, extruded and spun into a circular cross section fiber, at a melt temperature of about 200 to 210° C. Prior to melting, the mixture was blanketed, at the feed throat, with nitrogen.

The melt was extruded through a 64,030 hole extruder, and taken up at a rate of 16 meters per minute and drawn at a rate of 35 meters per minute, effecting a mechanical draw ratio of 2.2×. The drawn tow was crimped at about 35 crimps per inch (99 crimps per 10 cm), using a stuffer box. The fiber was coated with the same finish mixture as employed in the two step process, and cut to produce a staple fiber of 4.5 dtex, with a cut length of 48 mm.

The fibers were then carded into conventional fiber webs at 30.5 meters per minute (100 feet per minute), using equipment and procedures discussed in the previously discussed Legare 1986 TAPPI article.

In this regard, as with the two step process, three-ply webs of staple were identically oriented and stacked (primarily in the machine direction), and bonded—using a diamond design embossed calender roll, with a total bond area of about 15 percent, and a smooth roll, at roll temperatures ranging from 120 to 126° C., and roll pressures of 420 Newtons per linear centimeter (240 pounds per linear inch)—to obtain test nonwovens structures weighing nominally 48 grams per square meter (40 grams per square yard).

For other one step process Examples, the fibers were run using different ranges of roll temperatures. As discussed with reference to the two step process Examples, Table 6 likewise shows optimum temperature conditions for the one step process Examples. Also as with the two step process Examples, for the one step process Examples, test strips of each nonwoven structure, 1 inch×7 inches (25 mm×178 mm), were identically tested with the Instron Corporation tensile tester, for cross directional (CD) strength and elongation (to break).

Specific conditions employed, for the previously discussed Examples 1 and 4, as well as for the other Examples, are listed in Tables 3 and 4; characterizations of the fibers of each Example are shown below in Table 5, while Table 6 shows the cross directional properties of the carded, calendered nonwoven fabrics obtained from these fibers. The strength values are normalized for a basis weight of 48 grams per square meter (40 grams per square yard); the fabric elongation values are not normalized. Two different runs were conducted, for preparing fabrics from the fibers of Examples 23, 25, and 30; these are designated as A and B in Table 6.

TABLE 5

| Example | Fineness (dtex) | Tenacity (g/denier) | Elongation (%) | Finish (%) | CPI | Melting Point (°C.) Major | Melting Point (°C.) Minor |
|---|---|---|---|---|---|---|---|
| 1 | 3.3 | 1.27 | 386 | | 40.8 | 128 | — |
| 2 | 4.2 | 1.32 | 315 | 0.47 | 31.6 | 128 | — |
| 3 | 1.8 | | | | 24.3 | 127 | — |
| 4 | 4.5 | 1.20 | 293 | 0.50 | 35.6 | 127 | — |
| 5 | 3.5 | 1.21 | 386 | 0.79 | 26.9 | 128 | 161 |
| 6 | 3.5 | 1.26 | 380 | 0.82 | 33.7 | 127 | 161 |
| 7 | 3.6 | 1.11 | 352 | 0.78 | | 127 | 161 |
| 8 | 2.3 | 1.34 | 320 | 0.60 | 40.9 | 127 | — |
| 9 | 3.5 | 1.11 | 424 | 0.57 | 40.4 | 127 | 163 |
| 10 | 2.3 | 1.51 | 353 | 0.53 | 35.5 | 127 | 160 |
| 11 | 3.6 | 1.16 | 342 | 0.55 | | 126 | 163 |
| 12 | 2.5 | | 351 | 0.60 | | 127 | |
| 13 | 2.4 | | 350 | 0.60 | 24.0 | 160 | |
| 14 | 3.0 | 1.06 | 329 | 0.77 | 27.5 | | |
| 15 | 2.6 | 2.16 | 147 | 0.84 | 33.7 | 127 | |
| 16 | 3.3 | | | | | | |
| 17 | 3.3 | | | | | | |
| 18 | 4.4 | 0.90 | 399 | 0.63 | 31.0 | | |
| 19 | 3.3 | | | | | | |
| 20 | 5.0 | 1.14 | 396 | 0.56 | | | |
| 21 | 3.3 | | | 0.35 | | | |
| 22 | 2.4 | | | 0.42 | | | |
| 23 | 9.7 | 0.92 | 622 | 0.74 | 17.8 | | |
| 24 | 6.4 | 1.75 | 180 | 0.83 | 33.7 | | |
| 25 | 4.2 | 2.03 | 156 | 0.40* | 36.8 | | |
| 26 | 3.7 | 1.32 | 388 | 0.39* | 29.3 | | |
| 27 | 3.5 | 1.62 | 322 | 0.29* | 28.1 | | |
| 28 | 3.6 | 1.82 | 253 | 0.18* | 24.7 | | |
| 29 | 3.3 | 2.19 | 195 | 0.32 | 24.5 | | |
| 30 | 3.3 | 1.94 | 243 | 0.65 | | | |

*Hydrophobic Finish Used

TABLE 6

| Example | Line Speed (Ft/Min) | Roll Press (pli) | Roll Temp Smooth (°C.) | Roll Temp Embossed (°C.) | Fabric WT. (gsy) | CDS g/in | CDE % | CDS Normalized* g/in |
|---|---|---|---|---|---|---|---|---|
| 1 | 100 | 240 | 136 | 140 | 42.6 | 402 | 116 | 378 |
| 2 | 150 | 240 | 141 | 150 | 31.6 | 329 | 121 | 380 |
| 3 | 100 | 240 | 124 | 126 | 36.7 | 59 | 30 | 64 |

TABLE 6-continued

| Example | Line Speed (Ft/Min) | Roll Press (pli) | Roll Temp Smooth (°C.) | Roll Temp Embossed (°C.) | Fabric WT. (gsy) | CDS g/in | CDE % | CDS Normalized* g/in |
|---|---|---|---|---|---|---|---|---|
| 4 | 100 | 240 | 120 | 126 | 41.8 | 78 | 34 | 75 |
| 5 | 100 | 240 | 147 | 143 | 41.9 | 476 | 89 | 454 |
| 6 | 100 | 240 | 142 | 142 | 39.6 | 565 | 93 | 570 |
| 7 | 100 | 240 | 131 | 147 | 34.5 | 402 | 80 | 466 |
| 8 | 100 | 240 | 139 | 143 | 39.8 | 299 | 53 | 300 |
| 9 | 100 | 240 | 131 | 149 | 44.3 | 630 | 99 | 568 |
| 10 | 100 | 240 | 134 | 151 | 39.6 | 562 | 77 | 567 |
| 11 | 100 | 240 | 134 | 151 | 41.2 | 541 | 96 | 526 |
| 12 | 100 | 240 | — | — | — | — | — | — |
| 13 | 150 | 240 | 160 | 160 | 38.0 | 1000 | 150 | 1000 |
| 14 | 100 | 160 | 125 | 125 | 32.2 | 92 | 23 | 114 |
| 15 | 50 | 160 | 130 | 130 | 38.0 | 58 | 65 | 61 |
| 16** | 100 | 240 | 119 | 119 | 28.8 | 169 | 84 | 235 |
| 17 | 75 | 160 | 125 | 125 | 39.5 | 34 | 91 | 35 |
| 18 | 100 | 240 | 123 | 123 | 28.7 | 142 | 70 | 198 |
| 19 | 50 | 240 | 122.5 | 122.5 | 37.1 | 112 | 100 | 129 |
| 20 | 200 | 240 | 144 | 144 | 41.1 | 407 | 98 | 396 |
| 21 | 50 | 240 | 128 | 143 | 39.7 | 338 | 99 | 340 |
| 22 | 50 | 240 | 132 | 132 | 38.9 | 372 | 89 | 382 |
| 23B | 250 | 240 | 155 | 155 | 32.7 | 228 | 86 | 279 |
| 23A | 100 | 240 | 143 | 143 | 36.0 | 353 | 81 | 392 |
| 24 | 200 | 240 | 150 | 150 | 32.4 | 361 | 73 | 446 |
| 25A | 200 | 240 | 150 | 150 | 37.1 | 378 | 71 | 408 |
| 25B | 100 | 240 | 152 | 152 | 40.9 | 665 | 72 | 650 |
| 26 | 100 | 240 | 145 | 135 | 39.8 | 230 | 95 | 231 |
| 27 | 100 | 240 | 147 | 143 | 35.3 | 612 | 91 | 693 |
| 28 | 100 | 240 | 142 | 142 | | | | |
| 29 | 100 | 240 | 147 | 152 | 40.4 | 358 | 73 | 354 |
| 30A | 100 | 240 | 143 | 148 | 37.6 | 357 | 70 | 379 |
| 30B | 250 | 240 | 153 | 155 | 36.9 | 281 | 59 | 305 |

*Normalized to 40 grams per square yard.
**The fabric of Example 16 was made from a fiber blend including 90 percent by weight of the Example 16 fibers, and 10 percent by weight rayon fiber.

The fabrics of Examples 1, 3, 5–7, and 9–13, were tested for gamma radiation resistance, with the use of a cobalt-60 gamma radiation source at Neutron Products, Inc., Dickerson, Maryland; additionally, Tyvek fabric, from a laboratory coat, was thusly tested—for purposes herein, this fabric is designated as Example 31. Tyvek is a plastic-like, film-like 100 percent spunbonded, gel-spun, low melt index polyethylene, available from E.I. DuPont de Nemours Company, Wilmington, Del. Specifically, fabric of each Example was exposed to 60 kiloGray (kGy) units of radiation. Then test strips, of 25 mm ×178 mm (1 inch by 7 inches) were taken from each irradiated fabric, and from untreated fabric for each Example.

The treated and untreated test strips were then identically tested for machine directional tensile strength (MDS), using the Instron Corporation tensile tester. The machine directional tensile strength was measured 6, 33, and 62 days after irradiation of the treated strips (except in the case of Examples 3, and 31, for which the testing was conducted at 13, 27, and 62 days).

For the treated strips, the percent of machine directional tensile strength retained was also measured, at each of the three indicated points. This parameter was calculated as $(MDS_{irradiated})/(MDS_{untreated})\times 100\%$.

The results of the foregoing irradiation and tensile testing are shown in Table 7 below.

TABLE 7

| | | MDS | Aged 6 days | | Aged 33 days | | Aged 62 days | |
|---|---|---|---|---|---|---|---|---|
| Example | Fabric Wt (gsy) | (g/inch) (untreated) | MDS (g/inch) | % retention | MDS (g/inch) | % retention | MDS (g/inch) | % retention |
| 1 | 40.5 | 1895 | 1349 | 71.1 | 1466 | 77.4 | 1495 | 78.9 |
| 3* | 157 | 416 | 319 | 77 | 345 | 83 | 318 | 76 |
| 5 | 46.0 | 2282 | 1622 | 71.1 | 1625 | 71.2 | 1476 | 64.7 |
| 6 | 34.4 | 3087 | 2110 | 68.4 | 1848 | 59.9 | 2104 | 68.2 |
| 7 | 32.9 | 2134 | 1423 | 66.7 | 1169 | 54.8 | 1441 | 67.5 |
| 9 | 36.8 | 4031 | 2317 | 57.5 | 2394 | 59.4 | 2456 | 60.9 |
| 10 | 40.5 | 2348 | 1689 | 71.9 | 1908 | 81.2 | 1793 | 76.4 |
| 11 | 28.6 | 2443 | 1519 | 62.2 | 1781 | 72.9 | 1522 | 62.3 |
| 12 | 58.6 | 3059 | 2073 | 67.8 | 2078 | 67.9 | 2146 | 70.1 |
| 13 | 37.6 | 6101 | 936 | 15.3 | 513 | 8.4 | 414 | 6.8 |
| 31* | 34.4 | 4160 | 2825 | 68 | 2990 | 72 | 3125 | 75 |

TABLE 7-continued

| Example | Fabric Wt (gsy) | MDS (g/inch) (untreated) | Aged 6 days MDS (g/inch) | Aged 6 days % retention | Aged 33 days MDS (g/inch) | Aged 33 days % retention | Aged 62 days MDS (g/inch) | Aged 62 days % retention |
|---|---|---|---|---|---|---|---|---|

Example 3 was plyed and ultrasonically bonded
*Tested at 13, 27, 62 days

The percent MDS retention values provided in Table 7 were calculated using normalized MDS values. Specifically, the Table 7 MDS values were all normalized, to represent an equivalent MDS value at 40 grams per square yard (gsy) for the actual fabrics tested, which in most cases were about 40± 5 grams per square yard.

Such normalization corrected for the contribution of excess fabric basis weight to, or for the deficit of insufficient fabric weight from, the MDS and CDS values. For example, if a fabric had a basis weight of 43.6 grams per square yard, the normalized MDS value is tabulated as 40/43.6ths of the actual value obtained for that fabric.

As can be seen from the results set forth in Table 7, the fabrics of the invention—i.e., those of Examples 1, 5–7, and 9–12—all exhibited MDS retention values higher than that of the 100% polypropylene fabric of Example 13, at each of the three testing points.

Finally, although the invention has been described with reference to particular means, materials, and embodiments, it should be noted that the invention is not limited to the particulars disclosed, and extends to all equivalents within the scope of the claims.

What is claimed is:

1. A multiconstituent fiber, comprising a dominant continuous linear low density polyethylene phase and at least one discontinuous phase, dispersed through the dominant continuous phase in the form of domains, at least 70 percent by weight of the at least one discontinuous phase comprising domains having a diameter of about 0.05 to about 0.3 microns, the at least one discontinuous phase comprising at least one polymer selected from the group consisting of poly(propylene-co-ethylene) copolymers and polypropylene.

2. The multiconstituent fiber of claim 1, wherein the linear low density polyethylene has melting point approximately the same as, or lower than, the at least one polymer of the at least one discontinuous phase.

3. The multiconstituent fiber of claim 1, wherein the at least one discontinuous phase comprises about 10 percent to about 45 percent by weight of the fiber.

4. The multiconstituent fiber of claim 1, wherein the dominant continuous polyethylene phase comprises about 55 percent to about 90 percent by weight of the fiber.

5. The multiconstituent fiber of claim 1, wherein the at least one discontinuous phase comprises an isotactic polypropylene.

6. The multiconstituent fiber of claim 5, which is a biconstituent fiber of the linear low density polyethylene and the isotactic polypropylene.

7. The multiconstituent fiber of claim 1, wherein the at least one discontinuous phase comprises a poly(propylene-co-ethylene) copolymer.

8. The multiconstituent fiber of claim 7, which is a biconstituent fiber of the linear low density polyethylene and the poly(propylene-co-ethylene) copolymer.

9. The multiconstituent fiber of claim 7, wherein the at least one discontinuous phase further comprises an isotactic polypropylene.

10. A multiconstituent fiber, comprising a dominant continuous linear low density polyethylene phase and at least one discontinuous phase, dispersed through the dominant continuous phase in the form of domains, a majority by weight of the at least one discontinuous phase comprising domains having an average diameter of about 0.08 to about 0.12 microns, the at least one discontinuous phase comprising at least one polymer selected from the group consisting of poly(propylene-co-ethylene) copolymers and polypropylene.

11. The multiconstituent fiber of claim 10, wherein the linear low density polyethylene has a melting point approximately the same as, or lower than, the at least one polymer of the at least one discontinuous phase.

12. The multiconstituent fiber of claim 10, wherein the at least one discontinuous phase comprises about 10 percent to about 45 percent by weight of the fiber.

13. The multiconstituent fiber of claim 10, wherein the dominant continuous polyethylene phase comprises about 55 percent to about 90 percent by weight of the fiber.

14. The multiconstituent fiber of claim 10, wherein the at least one discontinuous phase comprises an isotactic polypropylene.

15. The multiconstituent fiber of claim 14, which is a biconstituent fiber of the linear low density polyethylene and the isotactic polypropylene.

16. The multiconstituent fiber of claim 10, wherein the at least one discontinuous phase comprises a poly(propylene-co-ethylene) copolymer.

17. The multiconstituent fiber of claim 16, which is a biconstituent fiber of the linear low density polyethylene and the poly(propylene-co-ethylene) copolymer.

18. The multiconstituent fiber of claim 16, wherein the at least one discontinuous phase further comprises an isotactic polypropylene.

19. An irradiated fiber, obtained by exposing the fiber of claim 1 to gamma radiation.

20. The fiber of claim 19, wherein the amount of gamma radiation is that which is sufficient for effecting sterilization.

21. The fiber of claim 20, wherein the amount of gamma radiation comprises at least 30 kGy.

22. An irradiated fiber, obtained by exposing the fiber of claim 10 to gamma radiation.

23. The irradiated fiber of claim 22, wherein the amount of gamma radiation is that which is sufficient for effecting sterilization.

24. The irradiated fiber of claim 23, wherein the amount of gamma radiation comprises at least 30 kGy.

* * * * *